US009586076B2

(12) United States Patent
Markelov

(10) Patent No.: US 9,586,076 B2
(45) Date of Patent: Mar. 7, 2017

(54) EXERCISE DEVICE

(71) Applicant: Vadim Evgenevich Markelov, Petrozavodsk (RU)

(72) Inventor: Vadim Evgenevich Markelov, Petrozavodsk (RU)

( * ) Notice: Subject to any disclaimer, the term of this patent is extended or adjusted under 35 U.S.C. 154(b) by 0 days.

(21) Appl. No.: 14/762,654

(22) PCT Filed: Dec. 30, 2013

(86) PCT No.: PCT/RU2013/001197
§ 371 (c)(1),
(2) Date: Jul. 22, 2015

(87) PCT Pub. No.: WO2014/120042
PCT Pub. Date: Aug. 7, 2014

(65) Prior Publication Data

US 2015/0321040 A1 Nov. 12, 2015

(30) Foreign Application Priority Data

Jan. 29, 2013 (RU) ..... 2013103874

(51) Int. Cl.
*A63B 21/08* (2006.01)
*A63B 21/00* (2006.01)
(Continued)

(52) U.S. Cl.
CPC ..... *A63B 21/00069* (2013.01); *A63B 21/06* (2013.01); *A63B 21/0616* (2015.10);
(Continued)

(58) Field of Classification Search
CPC . A63B 21/0615–21/0632; A63B 21/08; A63B 21/00069; A63B 21/078;
(Continued)

(56) References Cited

U.S. PATENT DOCUMENTS 4,266,766 A * 5/1981 Calderone ..... A63B 21/0615 482/137
4,344,619 A * 8/1982 Szabo ..... A63B 21/0615 248/161
(Continued)

FOREIGN PATENT DOCUMENTS

CN 202 355 784 8/2012
DE 176 916 11/1905
(Continued)

*Primary Examiner* — Loan H Thanh
*Assistant Examiner* — Gregory Winter
(74) *Attorney, Agent, or Firm* — Leason Ellis LLP

(57) ABSTRACT

An exercise machine in the form of a stationary rigid metal construction is provided, which includes a support frame having an axle. The axle is provided on the outer side of levers. The levers are pivotally mounted on the uprights of the support frame. Limiters for limiting the movement of a weight are in the form of transverse connections between the levers and are installed on both sides of the axle. A load guide is provided between the limiters and is in the form of a bent rod having two rectilinear portions and an arc. A limiter of lever position is in the form of a U-shaped frame and is affixed to the levers. A bench is mounted on the support frame.

2 Claims, 2 Drawing Sheets

(51) Int. Cl.
*A63B 21/06* (2006.01)
*A63B 71/00* (2006.01)
*A63B 21/078* (2006.01)
*A63B 71/02* (2006.01)

(52) U.S. Cl.
CPC ..... *A63B 21/0622* (2015.10); *A63B 21/0624* (2015.10); *A63B 21/0628* (2015.10); *A63B 21/078* (2013.01); *A63B 21/08* (2013.01); *A63B 21/4047* (2015.10); *A63B 71/0054* (2013.01); *A63B 71/02* (2013.01); *A63B 21/4035* (2015.10); *A63B 2071/0072* (2013.01); *A63B 2071/024* (2013.01)

(58) Field of Classification Search
CPC ..... A63B 21/0783; A63B 71/0054; A63B 2071/0072; A63B 2071/0081; A63B 21/4047
See application file for complete search history.

(56) References Cited

U.S. PATENT DOCUMENTS 4,666,154 A * 5/1987 Lipscomb ..... A63B 21/00047 482/142
4,765,611 A 8/1988 Macmillan
4,951,939 A * 8/1990 Peters ..... A63B 21/0615 482/94
5,304,108 A * 4/1994 Denega ..... A63B 21/225 482/110
5,336,148 A * 8/1994 Ish, III ..... A63B 21/0628 482/137
5,358,462 A * 10/1994 Calderone ..... A63B 21/0615 482/102
5,487,712 A * 1/1996 Kann ..... A63B 21/0615 482/148
7,070,543 B1 * 7/2006 Rindfleisch ..... A63B 21/0615 482/104
7,104,934 B1 9/2006 Smith
7,513,856 B2 * 4/2009 Jones ..... A63B 21/0728 482/107
2002/0037792 A1 * 3/2002 Smith ..... A63B 21/078 482/92
2009/0118104 A1 * 5/2009 Chou ..... A63B 21/00181 482/94
2010/0242644 A1 * 9/2010 Farbshteyn ..... A63B 21/0615 74/102

FOREIGN PATENT DOCUMENTS

DE 20 2006 00143 4/2006
RU 62338 U1 4/2007
RU 2297262 C2 4/2007
RU 85 093 U1 7/2009
RU 2375096 C2 12/2009

* cited by examiner

EXERCISE DEVICE

CROSS REFERENCE TO RELATED APPLICATIONS

The present application is a U.S. National Phase of International Patent Application PCT/RU2013/001197, filed Dec. 30, 2013, which claims priority to Russian Application No. 2013103874, filed on Jan. 29, 2013, the entire contents of which are incorporated herein by reference.

FIELD OF THE INVENTION

The invention relates to the field of exercise equipment, in particular to an exercise device, and can be employed for training and development of main muscle groups of adolescents and adults by exercising on open out-of-door sports grounds.

BACKGROUND

From the prior art, there are known exercise devices for training and development of main muscle groups by adolescents and adults exercising on out-of-door sports grounds.

There is known a stationary exercise device, comprising: an immobile frame formed by vertical posts connected to each other in upper and lower parts of a base; a seat for an exercising person; a handle; and an assembly for creating a counteracting force responsible for producing a load, said assembly comprising a lever with a movable fixing device located thereon and with a plurality of holes, wherein two hinge mounts are provided on both ends of the lever. By one of these mounts, the lower end of the lever is connected to a base of the frame, while the other mount connects the handle to the lever. To the lower part of the lever, one end of a wire rope is fixedly connected, which rope runs along the lever and passes through a roller of the movable fixing device and through a pulley wheel fixed on the upper part of the frame. A weight is fixed to the opposing end of the wire rope (see patent for utility model RU 85093 U1, Int. C1. A63B21/00, A63B23/00).

The drawbacks of this prior art device consist in low reliability and complicated adjusting of the load due to employment of the rope-and-pulley system.

There is known also a professional exercise device BODY-SOLID LVBP <<Horizontal bench press>> (see bluefrog-spb.ru/katalog), which is formed as a structure having a wide base. This structure comprises: a support frame having an axle and formed by two vertical posts; levers fixed to the axle of the frame and supplied with handles; a bench mounted on the frame; and guide members fixed to the outer sides of the levers with an appropriate number of weight elements mounted on the guide members in order to apply a desired load to the handles of the levers. Additional weight elements for adjusting the load are located on rods provided on side surfaces of the posts comprised by the support frame. To prevent inadvertent shifts of the weight elements during transportation, the guide members and rods are supplied with two locks.

The drawback of this prior art exercise device consists in that, in order to adjust the load applied to the levers, it is necessary to take off or to load some weight elements, wherein such adjustment of the load shall be performed at two sides of the exercise device.

Another drawback is constituted by necessity of fixing the weight elements, mounted on both sides, with the locks, which increases the time necessary for adjustment of the load and, therefore, decreases the time available for exercising. Moreover, there exists a possibility of dropping one or more of weight elements in the course of removing or installing them, which is disadvantageous for safety of the exercising person.

The technical solution which is closest to the invention in regard to its technical effect and an attained result is constituted by an exercise device, comprising: a support frame including an axle and posts; a weight; a guide member for the weight formed as a lever along which the weight can be shifted and fixed in the required position; and the lever having a handle. Both the guide member and the lever are pivotally mounted on the axle in the upper part of the support frame. The device further comprises a limiter of the lowermost position of the guide member and a movement limiter for the weight. Both levers are fixedly connected to each other and are located at one side of the axle (see. patent for utility model RU 62338 U1, Int. C1. A63B21/00). This exercise device may be employed in open out-of-door areas; however, it is not free from certain drawbacks.

Indeed, the closest prior art exercise device comprises the limiter which limits a downwards movement of the levers and determines their lowermost position. However, no limiter to limit an uppermost position of the levers is provided in the structure of the device. Therefore, overturning of the lever bearing the weight may take place if it is lifted by an exercising person up to a certain position. If, in result, a center of gravity of the weight passes over the axle of the support frame to be located to the left of this axle, a self-induced overturning of the lever with the weight can follow, which may result in hurting an exercising person. Another disadvantage consists in inability of adjusting the load applied to the handle of the lever as a known percentage ratio of the employed weight, so that the exercising person is unable to perform the adjustment of the load easily and quickly.

SUMMARY OF THE INVENTION

The object of the proposed technical solution is to broaden a range of devices designed for training and development of muscles by adults, as well as adolescents exercising on open out-of-door sports grounds in any season of the year by designing out-of-door exercise devices as stationary nondismountable rigid metal structures.

A technical result to be attained consists in increasing safety for an exercising person owing to prevention of an inadvertent shift of a weight along a guide member because tilting angles of the rectilinear portions of the guide member to a horizontal plane exceed 2°-3° irrespective of the position of the levers, and also in ensuring the adjustment of the load applied to the levers with handles by shifting weight elements relative to the axle of the support frame in accordance with the required percentage ratio in relation to a total weight of the weight elements.

To attain the above-indicated technical result, the proposed exercise device, which comprises: the support frame including posts and the axle, a weight; a guide member for the weight and a lever having a handle, both the guide member and the lever pivotally mounted on the axle; a limiter of the lowermost position of the guide member; and a movement limiter for the weight, is additionally provided, according to the invention, with an additional lever having a handle, wherein the guide member for the weight is fixedly positioned in a vertical plane between the movement limiters for the weight and is formed as a bent rod having two rectilinear portions connected by a rounded corner, wherein the rectilinear portions are tilted to a horizontal plane at an angle corresponding to at least 2°-3° irrespective of the position of the levers with handles; the weight is constituted by a set of separate weight elements and is distributed, in the selected proportion, between parts of the guide member located on both sides of the axle, the levers with handles are pivotally mounted on the posts of the support frame symmetrically to the guide member; and wherein the limiter of the uppermost position and of the lowermost position of the levers is formed as an U-shaped frame affixed to the levers, while the axle of the support frame is made in the form of two coaxial half-axles fixedly mounted on outer surfaces of the levers and pivotally connected to the posts of the support frame.

The presence of the above-indicated essential distinctive features ensures compliance of the claimed technical solution with the patentability condition of novelty.

The prior art analysis conducted by the applicant, the analysis including a search in patents and in non-patent scientific and technical information sources, with retrieving sources comprising data on prior art exercise devices, made it possible to conclude that there do not exist any prior art devices characterized by features identical to the entirety of the essential features of the proposed technical solution, while a selection, among retrieved exercise devices, the closest prior art device permitted to identify the distinguishing features of the claimed device, which features are essential for attainment of the above-specified technical results.

In order to check compliance with the patentability condition of "inventive step" the applicant has conducted an additional search and analysis of prior art solutions with the aim to retrieve features coinciding with the features distinguishing the invention from the selected prior art device. The results of this search have shown that the claimed technical solution does not follow, in an obvious way, from the prior art identified as such by the applicant. In other words, a comparison of the proposed technical solution not only with the closest prior art device but also with other technical solutions in the same and similar fields of sports equipment has revealed that these solutions do not comprise features similar to those features which distinguish the claimed technical solution from the closest prior art solution. Therefore, it may be concluded that the claimed exercise device complies with the patentability condition of "inventive step".

DETAILED DESCRIPTION

The proposed technical solution will be further described with a reference to a particular embodiment thereof clearly demonstrating capability to attain the target technical result by means of the above-indicated entirety of essential features.

Figure 1:
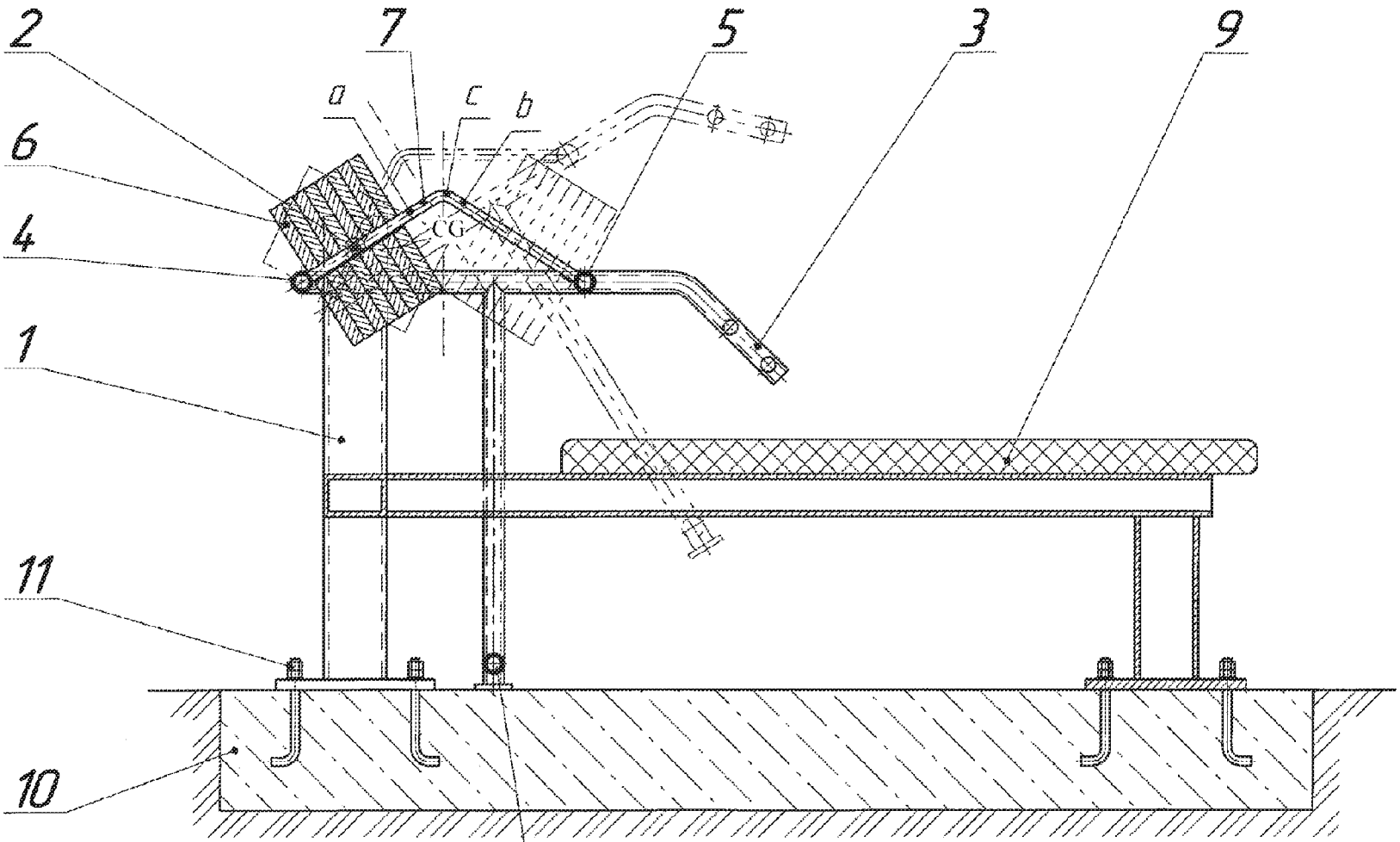
FIG. 1 gives a general view of the claimed exercise device representing the proposed technical solution and designed as a nondismountable rigid metal structure.
Figure 2:
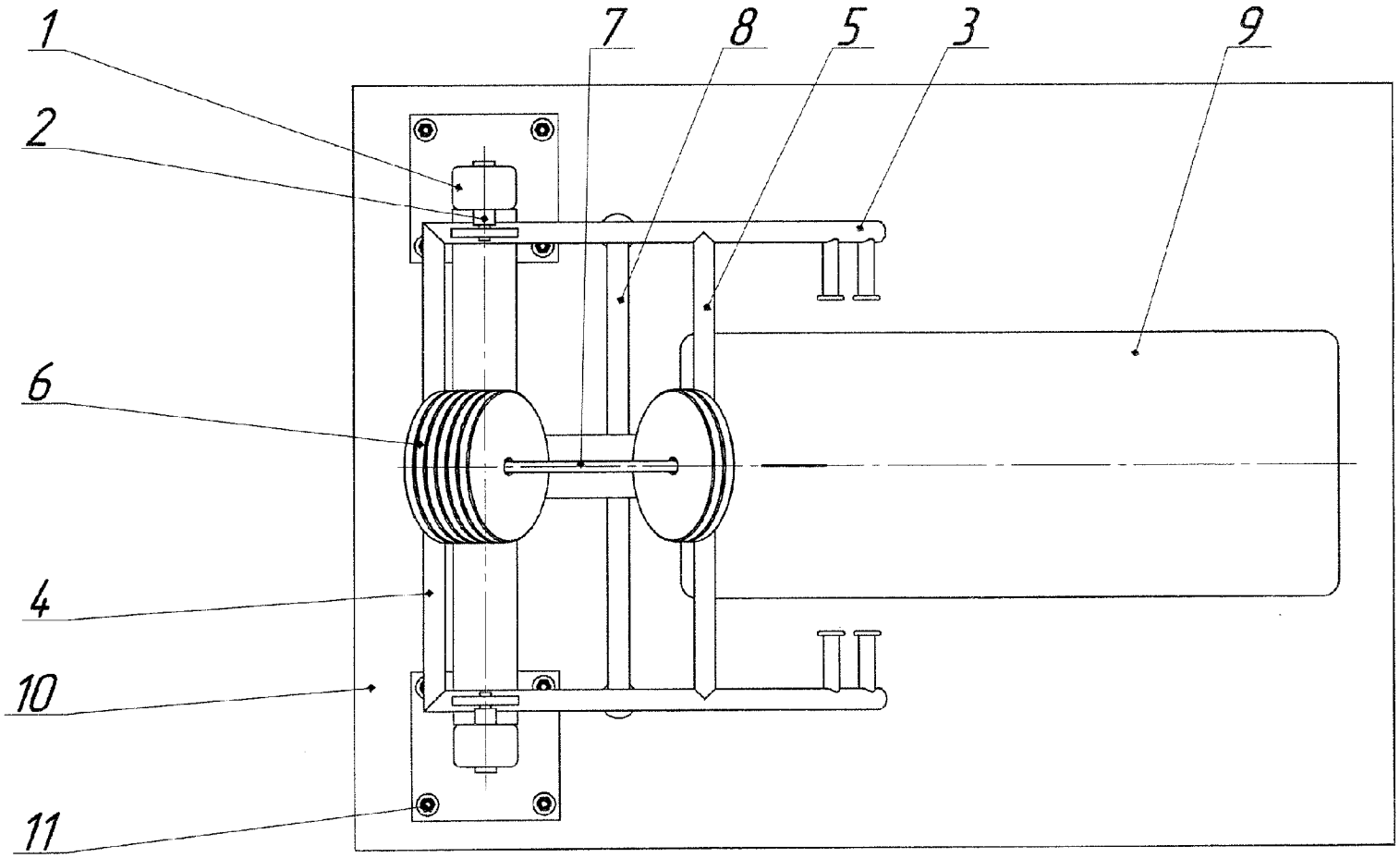
FIG. 2 provides a top view of the claimed exercise device representing the proposed technical solution and designed as a nondismountable rigid metal structure.

In accordance with the technical solution (see FIGS. 1 and 2), an exercise device includes a support frame 1 with an axle 2. The axle 2 consists of two coaxial half-axles (not denoted in FIG. 1) positioned at the outer side of the levers 3. The latter are pivotally mounted to uprights, or posts, (not denoted in FIG. 1) of the support frame 1. Limiters, or stoppers 4 and 5 for limiting the movement of weight elements 6 are formed as transverse members located between the levers 3 and located on both sides of the axle 2. Guide member 7 for the weight elements, which is arranged between limiters 4 and 5, is formed as a bent rod having two rectilinear portions a and b connected by a rounded corner, or an arc c. The guide member 7 is installed in such a way that the axle 2 of the support frame 1 passes through the common center of gravity, CG, of the entire set of weight elements 6 located (for the orientation presented in FIG. 1) to the left of the rounded corner c. The rectilinear portions a and b of the guide member 7 are tilted to a horizontal plane at an angle corresponding to at least 2°-3° irrespective of the position of the levers 3. The weight elements 6 are distributed, in the desired percentage ratio, between parts of the guide member 7 located on both sides of the axle 2. The limiter 8 of the positions of the levers is shaped as a U-shaped frame which is affixed to the levers 3. A bench 9 is mounted on the support frame 1. The device is affixed to a base 10 by means of fasteners 11.

The exercise device functions as follows.

In the initial state, the levers 3 rest on the limiter 8 and so are in their lowermost position, wherein the limiter 8 abuts the base 10. The entire set of the weight elements 6 is in its extreme left position. With the weight elements in this position, the axle 2 of the support frame 1 passes through the common center of gravity CG of the set of weight elements. In this position, a load applied to handles, or grips (not denoted in FIG. 1) of the levers 3 is minimal.

Before beginning an exercise an exercising person adjusts a level of the load applied to the grips of the levers 3. With this purpose, he (or she) shifts a part of the weight elements 6 (selected in the desired percentage ratio of the total weight) along the guide member 7 all the way to the limiter 5. By shifting the total set of the weight elements 6 to the extreme right position, the load on the grips of the levers 3 is maximized. It shall be noted that a range of lifting the lever 3 upward is limited by the lower part of the limiter 8. In the course of exercise the exercising person grips the handles (not denoted in FIG. 1) of the levers 3 and periodically lifts and lowers them, lifting and lowering in this way the guide member 7 with weight elements 6.

The safety of the exercising person during this process is ensured because inadvertent shifting of the weight elements 6 along the guide member 7 is impossible owing to that the tilting angles of the rectilinear portions (not denoted in FIG. 1) of the guide member 7 to the horizontal plane are made exceeding 2°-3° irrespective of the position of the levers 3.

With this exercise device, the exercising person can perform exercises in three different positions: when standing, sitting, or lying. For example, exercising person can perform exercises for training muscles of his (hers) back and legs when standing on the bench 9 or on the base 10.

The exercising person can perform also the chest press exercise when sitting or lying on the bench 9. By performing this exercise the exercising person can train the muscle group of the shoulder girdle. When lying face upwards on the bench 9 and thrusting the legs against the handles (not denoted in FIG. 1) of the levers 3 one can perform exercises for leg muscles.

By designing the exercise device as a stationary nondismountable rigid metal structure not requiring any technical servicing (such as adjusting, oiling, etc.), "anti-vandal" protection is attained, which allows to install the exercise device in open out-of-door areas, while easiness and speed of setting the load makes the device suitable for the wide use.

INDUSTRIAL APPLICABILITY

The proposed exercise device does not create any problems in the course of its manufacturing. Moreover, the above description makes it clear that the claimed exercise device, as it is characterized in the single claim can be produced by employing known techniques and production means. The present invention can be effectively employed for training and development of main muscle groups of adolescents and adults by exercising on open out-of-door sports grounds.

The invention claimed is:

1. An exercise device, comprising:

a support frame including posts and an axle;

a weight;

a guide member for the weight and a pair of levers each having a handle, both the guide member and the levers pivotally mounted on the axle;

a limiter of the levers; and a pair of movement limiters for the weight, wherein the guide member for the weight is positioned in a vertical plane between the movement limiters for the weight and is formed as a bent rod having two rectilinear portions connected by a rounded corner; wherein the weight is constituted by a set of separate weight elements that are moveable along the guide member and are distributed, in a selected percentage ratio, on one of the two rectilinear portions of the guide member located on both sides of the axle, the levers are pivotally mounted on the posts of the support frame symmetrically to the guide member, and wherein the limiter of the levers is formed as a U-shaped frame affixed to the levers, while the axle of the support frame is made in the form of two coaxial half-axles fixedly mounted on outer surfaces of the levers and pivotally connected to the posts of the support frame.

2. An exercise device, comprising:

a support frame including posts and an axle;

a weight;

a guide member for the weight;

a pair of levers wherein the levers are pivotally attached to the posts about a common pivot axis;

a limiter of the levers; and a pair of movement limiters for the weight, wherein the guide member for the weight is formed as a bent rod having two rectilinear portions connected by a rounded corner and is positioned between the movement limiters for the weight;

wherein the weight is constituted by a set of separate weight elements that are movable along the guide member and can be distributed in a selected percentage ratio on one of the two rectilinear portions of the guide member; and wherein the limiter of the levers is formed as a U-shaped frame affixed to the levers, and the axle of the support frame is fixedly mounted on outer surfaces of the levers and pivotally connected to the posts of the support frame.

* * * * *